US009026021B2

(12) United States Patent
Shimizu

(10) Patent No.: US 9,026,021 B2
(45) Date of Patent: May 5, 2015

(54) ROLLER CLEANING DEVICE AND IMAGE FORMING APPARATUS

(75) Inventor: Yoshikazu Shimizu, Aichi (JP)
(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 61 days.

(21) Appl. No.: 13/359,622

(22) Filed: Jan. 27, 2012

(65) Prior Publication Data

US 2012/0251214 A1 Oct. 4, 2012

(30) Foreign Application Priority Data

Mar. 29, 2011 (JP) ..... 2011-072346

(51) Int. Cl.
*G03G 15/20* (2006.01)
*G03G 15/00* (2006.01)
*G03G 21/00* (2006.01)

(52) U.S. Cl.
CPC ..... *G03G 15/6558* (2013.01); *G03G 15/6529* (2013.01); *G03G 21/00* (2013.01); *G03G 2215/00679* (2013.01)

(58) Field of Classification Search
CPC ..... G03G 21/00
USPC ..... 399/326, 327, 394, 395, 388, 34, 35, 399/123
See application file for complete search history.

(56) References Cited

U.S. PATENT DOCUMENTS 5,351,108 A 9/1994 Mizutani
5,692,747 A 12/1997 Guerrero et al.
5,740,498 A * 4/1998 Tsuchiya ..... 399/98
6,219,505 B1 4/2001 Sato et al.
6,415,119 B2 7/2002 Nishimura et al.
6,505,019 B2 * 1/2003 Sato et al. ..... 399/98
6,708,009 B2 * 3/2004 Fuwazaki et al. ..... 399/98
7,149,455 B2 12/2006 Hattori
7,149,456 B2 * 12/2006 Yamagata ..... 399/98

(Continued)

FOREIGN PATENT DOCUMENTS

JP 03-115030 5/1991
JP 06-336348 12/1994
JP 07-230225 8/1995
JP 2001-225981 A 8/2001
JP 2001-270631 A 10/2001
JP 2005-041652 A 2/2005
JP 2006248652 A * 9/2006
JP 2007-030996 A 2/2007
JP 2009-047911 3/2009
JP 2009-090582 A 4/2009
JP 2010-052907 A 3/2010
JP 2010-222107 A 10/2010
JP 2011-032057 2/2011
JP 2012-206805 A 10/2012

OTHER PUBLICATIONS

Co-pending U.S. Appl. No. 14/013,486, filed Aug. 29, 2013.
Oct. 24, 2014 (US)—Non-Final Office Action—U.S. Appl. No. 14/013,486.
Apr. 29, 2014 Office Action issued in Chinese Patent Application No. 201210022036.0.

*Primary Examiner* — Matthew G Marini
*Assistant Examiner* — John M Royston
(74) *Attorney, Agent, or Firm* — Banner & Witcoff, Ltd.

(57) ABSTRACT

An image forming apparatus is provided. The image forming apparatus includes a pair of register rollers including a driving roller and a dust remover roller, a dust scraper to scrape off dust from the dust remover roller, a dust container box, including a lateral plate and a protrusion, to contain the dust scraped off from the dust remover roller, a roller bearing attached to the lateral plate to be immovable and to rotatably support the dust remover roller, a scraper support swingably supported by the dust container box and to support the dust scraper, and a frame to swingably support the dust container box via a protrusion support, to rotatably support the driving roller, while a rotation axis of the driving roller is fixed to the frame, and to support the roller bearing to be slidable in an in-axes direction between the driving roller and the dust remover roller.

7 Claims, 8 Drawing Sheets

(56) References Cited

U.S. PATENT DOCUMENTS

| | | | | |
|---|---|---|---|---|
| 7,496,317 | B2 * | 2/2009 | Igarashi et al. | 399/124 |
| 7,522,872 | B2 | 4/2009 | Fukuta | |
| 7,869,735 | B2 * | 1/2011 | Hattori | 399/98 |
| 7,890,016 | B2 | 2/2011 | Ota | |
| 8,028,992 | B2 | 10/2011 | Terao | |
| 8,042,589 | B2 | 10/2011 | Hanada | |
| 8,045,880 | B2 | 10/2011 | Hirose | |
| 8,543,051 | B2 | 9/2013 | Akatsuka et al. | |
| 2001/0028813 | A1 | 10/2001 | Nishimura et al. | |
| 2001/0031154 | A1 | 10/2001 | Sato et al. | |
| 2003/0049043 | A1 | 3/2003 | Fuwazaki et al. | |
| 2005/0019073 | A1 | 1/2005 | Hattori | |
| 2009/0052935 | A1 | 2/2009 | Ota | |
| 2009/0095182 | A1 | 4/2009 | Hanada | |
| 2010/0052244 | A1 | 3/2010 | Terao | |
| 2012/0251214 | A1 | 10/2012 | Shimizu | |

* cited by examiner

ROLLER CLEANING DEVICE AND IMAGE FORMING APPARATUS

CROSS REFERENCE TO RELATED APPLICATION

This application claims priority from Japanese Patent Application No. 2011-072346, filed on Mar. 29, 2011, the entire subject matter of which is incorporated herein by reference.

BACKGROUND

1. Technical Field

An aspect of the present invention relates to an image forming apparatus, which is configured to convey a sheet of recording medium and form an image on the recording medium.

2. Related Art

An image forming apparatus, such as a laser printer, in which sheets of recording media stacked in a sheet tray or a sheet cassette are picked up by a feed roller and conveyed to an image forming unit one-by-one, is known. In the image forming unit, an electrostatic latent image formed on a surface of a latent image carrier (e.g., a photosensitive drum) is developed to be a toner image, and the toner image on the latent image carrier is transferred onto the sheet being conveyed. Thus, an image is formed on the sheet of recording medium.

When the sheets of paper are conveyed in the image forming apparatus in a flow along a sheet conveying direction, the sheets may carry paper dust thereon. The dust may rise and adhere onto the sheets in various situations. For example, the dust may be caused by friction when the sheet is picked up by the feed roller and float in the image forming apparatus. Moreover, the sheets stored in the sheet tray may already contain dust in there-between. Whilst the dust may cause adverse effects in an image forming operation, in order to remove the dust, the image forming apparatus may have a system to remove the dust from the sheet being carried toward the image forming unit. The dust removal system may be arranged in an upstream position with respect to the image forming unit along the sheet conveying direction.

A dust removal system provided in a pair of register rollers, which correct an orientation of the sheet being conveyed, is known. More specifically, one of the paired register rollers may serve as a dust remover roller to absorb the dust from the sheet. The dust adhered onto the dust remover roller may be scraped off from the dust remover roller by a sheet of scraper.

SUMMARY

In the image forming apparatus with the dust removal system in the register rollers, in order to allow various-typed sheets (e.g., sheets in various sizes and thicknesses) to be used, it is required that the register rollers are slidable with respect to each other along an in-axes direction (an in-axes direction herein refers to a direction of a line, which connects rotation axes of the register rollers). When one of the register rollers is slidable with respect to each other, and the other of the register rollers is fixed, it is desirable that the dust remover roller is configured to be slidable with respect to the other one of the register rollers in consideration of sheet-conveying accuracy.

When the dust remover roller moves along the in-axes direction, positional relation between the dust remover roller and the scraper changes, and the positional change may cause problems. For example, the scraper may not always be maintained in a position to effectively scrape the dust off from the dust remover roller. Further, the dust scraped off from the dust remover roller may not be collected properly but may fall outside the dust removal system.

In view of the problems, the present invention is advantageous in that an image forming apparatus, in which the sheets are properly carried and the dust is effectively removed, is provided.

According to an aspect of the present invention, an image forming apparatus, which is configured to convey a sheet of recording medium and form an image on the sheet in an image forming unit, is provided. The image forming apparatus includes a pair of register rollers including a driving roller, which is configured to be rotated to convey the sheet toward the image forming unit and have a rubber-made circumferential layer, and a dust remover roller, which is configured to have a smooth circumferential surface to remove dust from the sheet being conveyed and is arranged in a position opposite from the driving roller, the register rollers being configured to correct an orientation of the sheet being carried by having an edge of the sheet to hit a closest section, in which the driving roller and the dust remover roller become closest to each other, a dust scraper, which is arranged to face and to be in contact with the circumferential surface of the dust remover roller to scrape off the dust from the circumferential surface of the dust remover, a dust container box including at least a lateral plate, which is arranged orthogonally to a rotation axis of the dust remover roller, and a cylindrical-shaped pin, which is configured to protrude outwardly from the lateral plate, the dust container box being configured to have a shape of a box to contain the dust scraped off from the circumferential surface of the dust remover roller by the dust scraper, a roller bearing, which is configured to penetrate the lateral plate and attached to the lateral plate to be immovable with respect to the lateral plate in the direction of rotation axis of the dust remover roller and configured to rotatably support the dust remover roller within the dust container box, a scraper support, which is arranged in the dust container box and is configured to be swingably supported by the dust container box to swing about a swing axis being in parallel with the rotation axis of the dust remover roller, and to support the dust scraper at a position apart from the swing axis, and a frame configured to support the dust container box swingably in a groove, which is formed along a direction from the rotation axis of the dust remover roller toward the swing axis of the scraper support and is configured to support the pins slidably and rotatably therein, the frame being configured to rotatably support the driving roller, whilst a rotation axis of the driving roller is fixed with respect to the frame, and to support the roller bearing to be slidable in an in-axes direction between the driving roller and the dust remover roller.

According to another aspect of the present invention, an image forming apparatus, which is configured to convey a sheet of recording medium and form an image on the sheet in an image forming unit, is provided. The image forming apparatus includes a pair of register rollers including a driving roller, which is configured to be rotated to convey the sheet toward the image forming unit and have a rubber-made circumferential layer, and a dust remover roller, which is configured to have a smooth circumferential surface to remove dust from the sheet being conveyed and is arranged in a position opposite from the driving roller, the register rollers being configured to correct an orientation of the sheet being carried by having an edge of the sheet to hit a closest section, in which the driving roller and the dust remover roller become closest to each other, a dust scraper, which is arranged to face and to be in contact with the circumferential surface of the dust remover roller to scrape off the dust from the circumferential surface of the dust remover, a dust container box including at least a lateral plate, which is arranged orthogonally to a rotation axis of the dust remover roller, and a protrusion, which is configured to protrude outwardly along the direction of the rotation axis of the dust remover roller from the lateral plate, the dust container box being configured to have a shape of a box to contain the dust scraped off from the circumferential surface of the dust remover roller by the dust scraper, a roller bearing, which is configured to penetrate the lateral plate and attached to the lateral plate to be immovable with respect to the lateral plate in the direction of rotation axis of the dust remover roller and configured to rotatably support the dust remover roller within the dust container box, a scraper support, which is arranged in the dust container box and is configured to be swingably supported by the dust container box to swing about a swing axis being in parallel with the rotation axis of the dust remover roller, and to support the dust scraper at a position apart from the swing axis, and a frame configured to swingably support the dust container box via a protrusion support, which supports the protrusion of the dust container box slidably along a direction from the rotation axis of the dust remover roller toward the swing axis of the scraper support and rotatably therein, the frame being configured to rotatably support the driving roller, whilst a rotation axis of the driving roller is fixed with respect to the frame, and to support the roller bearing to be slidable in an in-axes direction between the driving roller and the dust remover roller.

BRIEF DESCRIPTION OF THE ACCOMPANYING DRAWINGS

DETAILED DESCRIPTION

Hereinafter, an embodiment of the present invention will be described with reference to the accompanying drawings.

Overall Configuration of Color Laser Printer

Figure 1:
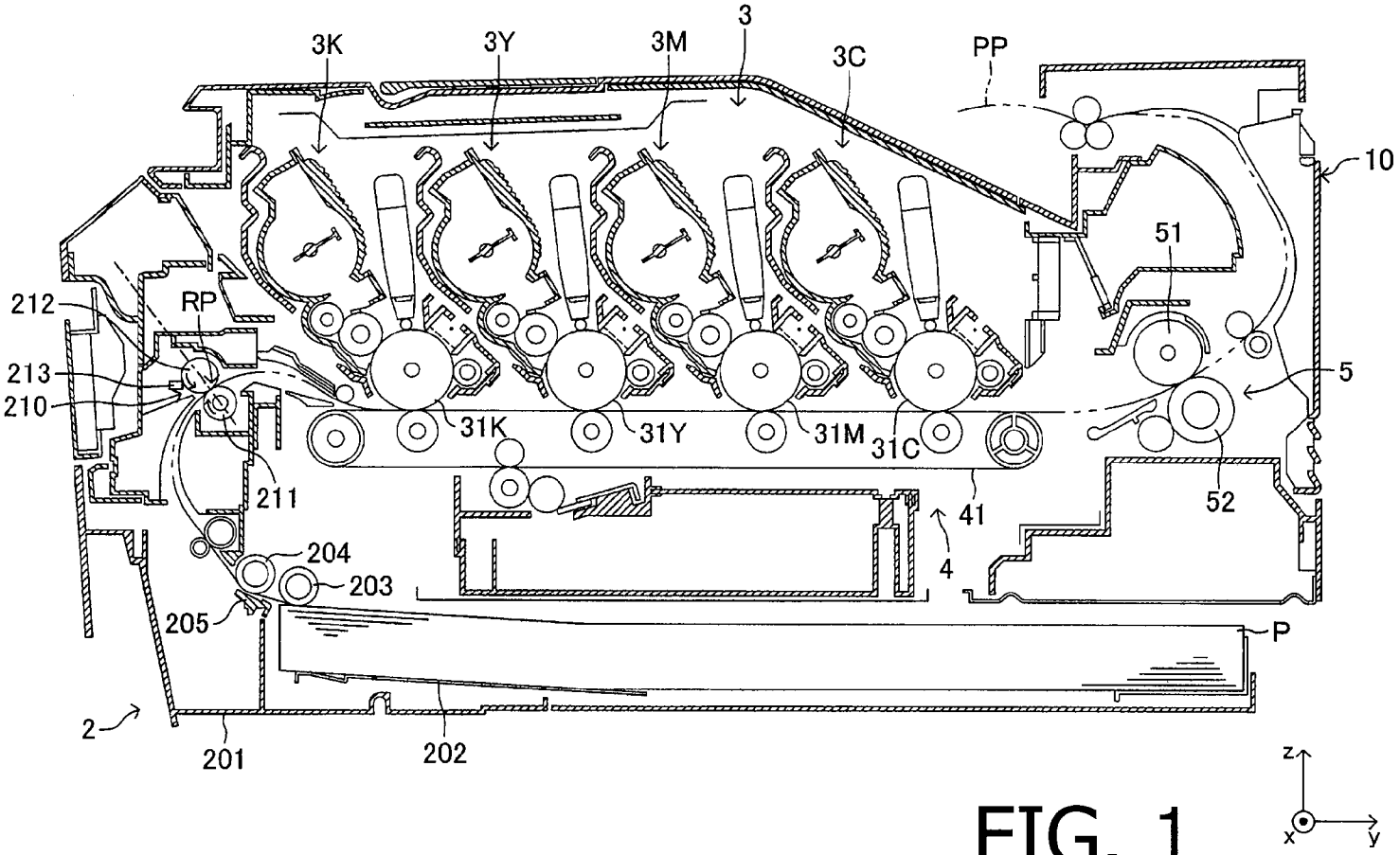
FIG. 1 is a cross-sectional side view of a color laser printer according to an embodiment of the present invention.

An overall configuration of a color laser printer 1 according to the embodiment will be described with reference to FIG. 1. In the present embodiment described below, directions concerning the color laser printer 1 will be based on a user's position to ordinarily use the color laser printer 1 and in accordance with orientation indicated by arrows in each drawing. That is, for example, a viewer's left-hand side appearing in FIG. 1 closer to a negative-value side along a y-axis is referred to as a front side of the color laser printer 1. A right-hand side in FIG. 1 opposite from the front, which is closer to a positive-value side along the y-axis, is referred to as rear. The front-rear direction of the color laser printer 1 may also be referred to as a direction of depth. An up-down direction along a z-axis in FIG. 1 corresponds to a vertical direction of the image forming apparatus. The vertical direction may also be referred to as a direction of height. A side, which corresponds to the viewer's nearer side along an x-axis is referred to as a left-side face, and an opposite side from the left, which corresponds to the viewer's further side along the x-axis, is referred to as a right-side face. The right-left direction of the color laser printer 1 may also be referred to as a widthwise direction and a direction of sheet-width.

The color laser printer 1 conveys a sheet of paper P along a sheet path PP and forms a multi-colored image in toners being dry developers on the sheet P. In the present embodiment, a tangential direction in any position on the sheet path PP, along which the sheet P is conveyed, is referred to as a sheet-conveying direction. According to the embodiment, the color laser printer 1 includes a sheet feeder unit 2, an image forming unit 3, a transfer unit 4, and a fixing unit 5. The image forming unit 3 includes a black image forming unit 3K, a yellow image forming unit 3Y, a magenta image forming unit 3M, and a cyan image forming unit 3C. The image forming unit 3, the transfer unit 4, and the fixing unit 5 are stored in a body 10 of the color laser printer 1.

The black image forming unit 3K, the yellow image forming unit 3Y, the magenta image forming unit 3M, and the cyan image forming unit 3C are arranged in parallel with one another to align in the order described above from the front side toward the rear side. The black image forming unit 3K, the yellow image forming unit 3Y, the magenta image forming unit 3M, and the cyan image forming unit 3C has photosensitive drums 31K, 31Y, 31M, 31C for forming images in black, yellow, magenta, and cyan respectively. The photosensitive drums 31K, 31Y, 31M, 31C are arranged to align in parallel with one another. On circumferential surfaces of the photosensitive drums 31K, 31Y, 31M, 31C, toner images in black, yellow, magenta, and cyan are respectively formed to be carried.

The transfer unit 4 is arranged in a lower opposite position from the photosensitive drums 31K, 31Y, 31M, 31C and includes a transfer belt 41 being an endless belt. The sheet P conveyed to the transfer unit 4 is carried on an upper outer surface of the transfer belt 41 along the photosensitive drums 31K, 31Y, 31M, 31C. Thus, the toner images formed on the circumferential surfaces of the photosensitive drums 31K, 31Y, 31M, 31C are transferred onto the sheet P.

The fixing unit 5 is arranged in a downstream position with respect to the transfer unit 4 along the sheet-conveying direction. The fixing unit 5 includes a heat roller 51 and a pressure roller 52, which nip the sheet P in there-between and fix the toner images transferred onto the sheet P by heat and pressure.

Configuration of the Sheet Feeder Unit

The sheet feeder unit 2 feeds and conveys the sheet P toward the position, in which the image forming unit 3 and the transfer unit 4 face each other. More specifically, the sheet feeder unit 2 conveys the sheet P toward the position, in which the black image forming unit 3K in a most upstream position along the sheet-conveying direction amongst the image forming units 3K, 3Y, 3M, 3C facing the transfer unit 4. The sheet feeder unit 2 includes a sheet-feed cassette 201, a sheet lifter 202, a pickup roller 203, and a separator roller 204.

The sheet-feed cassette 201 is a tray to store the sheets P of recording paper in a stack. The sheet lifter 202 is arranged inside the sheet-feed cassette 201 and uplifts front end portions of the sheets P stacked in the sheet-feed cassette 201. It is to be noted that, in terms of the sheets P in the color laser printer 1 according to the present embodiment, the front end of the sheet P is referred to with respect of a direction of travel of the sheet P. In other words, the front end of the sheet P refers to one of lengthwise ends, which enters the sheet path PP firstly when the sheet P is conveyed, regardless of the orientation of the color laser printer 1.

The pickup roller 203 is disposed in a lower front section in the color laser printer 1 in a position to become in contact with the front end portion of the sheet P uplifted by the sheet lifter 202. As the pickup roller 203 rotates, the sheet P being in contact with the pickup roller 203 is picked up at the front end portion and forwarded in the sheet path PP.

Figure 2:
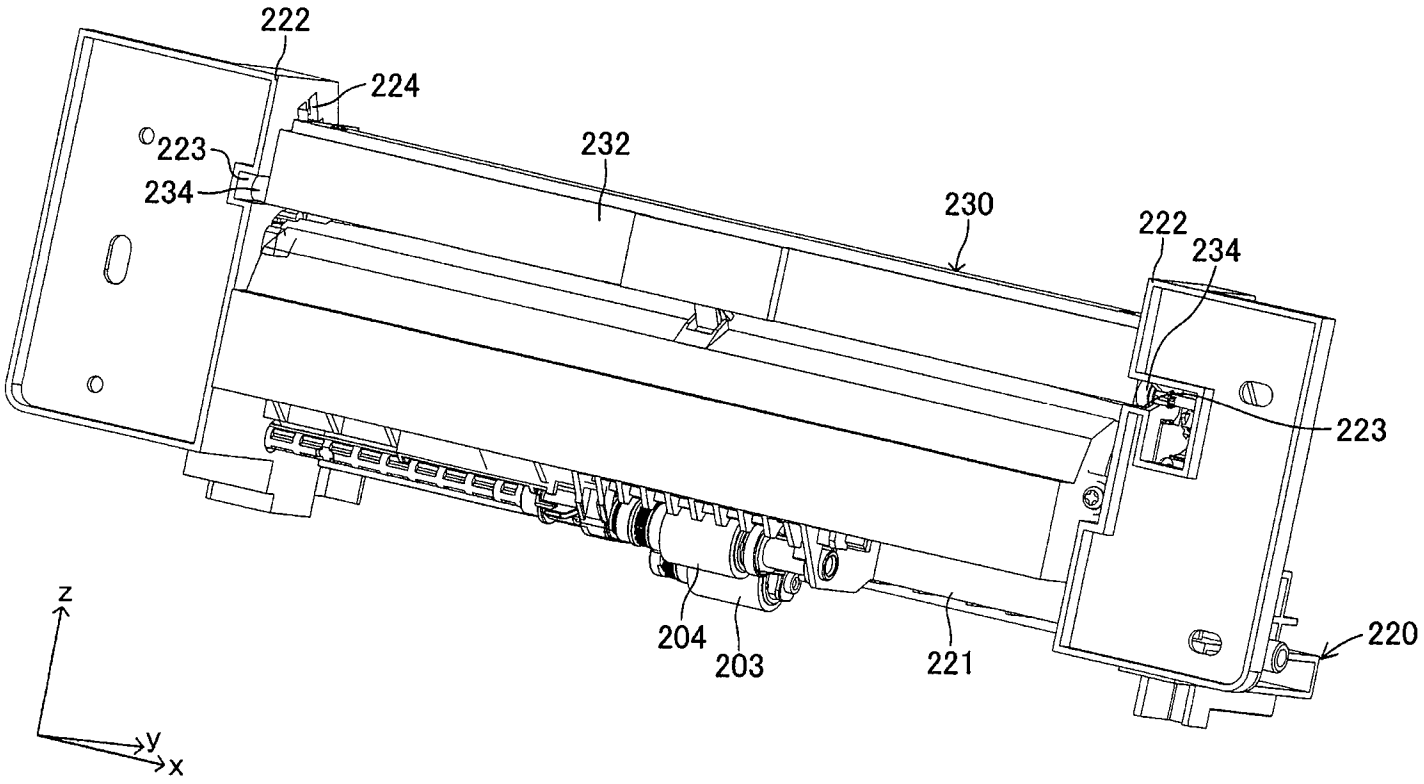
FIG. 2 is a perspective view of a sheet feeder unit in the color laser printer according to the embodiment of the present invention.

The separator roller 204 is disposed in a forwarded position for the sheet P, which has been picked up and forwarded by the pickup roller 203, and in a position to adjoin the pickup roller 203 (see FIG. 2). The pickup roller 203 and the separator roller 204 are formed to have widths, which are smaller than a width of a maximum allowable-sized sheet P for the image forming unit 3. The width of a maximum allowable-sized sheet P for the image forming unit 3 may be, for example, 210 mm when the maximum allowable size for the sheet P is "A4" (210 mm×297 mm). The pickup roller 203 and the separator roller 204 are arranged in a position to become in contact with a widthwise central portion of the sheet P.

The separator pad 205 is disposed in a lower opposite position with respect to the separator roller 204 across the sheet path PP. A surface of the separator pad 205 facing the separator roller 204 is made of a material with higher frictional coefficient with respect to frictional coefficient of the sheet P (e.g., rubber). The separator pad 205 is resiliently urged upwardly by a spring (not shown) toward the separator roller 204.

The sheet feeder unit 2 further includes a pair of register rollers 210. The paired register rollers 210 are arranged in upper position with respect to the pickup roller 203 and the separator roller 204. With the arrangement of the rollers, the sheet path PP originates from an immediate below position with respect to the pickup roller 203 and extends frontward toward the position between the separator pad 204 and the separator pad 205. Further, the sheet path PP turns upwardly toward the register rollers 210 and is reversed rearward at a front position with respect to the register rollers 210.

The paired register rollers 210 includes a driving register roller 211 and a dust remover roller 212. The driving register roller 211 is a rubber roller, which has a rubber-made circumferential layer, and is arranged in a lower opposite position from the dust remover roller 212 across the sheet path PP. The dust remover roller 212 is a rigid roller, which has a smooth circumferential surface (e.g., a fluorine synthetic resin-coated surface) to remove dust from the sheet P. The dust remover roller 212 is arranged in an upper position, on a side where the image forming unit 3 is provided, with respect to the sheet path PP.

The driving register roller 211 and the dust remover roller 212 are arranged to be in closest positions to each other and to be in contact with each other at a register position PR. The driving register roller 211 and the dust remover roller 212 are driven by driving force transmitted via a driving force transmission system (not shown) and convey the sheet P along the sheet-conveying direction in the sheet path PP. Thus, the register rollers 210 correct the orientation of the sheet P with respect to the sheet-conveying direction when the sheet P being conveyed in a skewed orientation comes to the register position RP and hits the register rollers 210. Further, the register rollers 210 adjust timings for the sheet P to be fed in the facing position, in which the image forming unit 3 and the transfer unit 4 face each other.

The register roller 211 and the dust remover roller 212 are configured to be in such forms that at least parts of the register roller 211 and the dust remover roller 212 consisting of the register position RP have widths, which correspond to the width of the maximum allowable-sized sheet P for the image forming unit 3. In particular, the parts consisting of the register position RP have widths which are substantially greater than the width of the maximum allowable-sized sheet P. Thus, the dust can be removed from the sheets P in various sizes even more steadily and evenly as long as the sizes of the sheets P are smaller than or equivalent to the maximum-allowable size.

In a position closer to the front with respect to the dust remover roller 212, a scraper pad 213 is arranged to be in contact with the circumferential surface of the dust remover roller 212 along the entire width of the dust remover roller 212. More specifically, the scraper pad 213 is arranged in an opposite position from the circumferential surface of the dust remover roller 212 to scrape off the dust adhered onto the circumferential surface by a rear edge thereof and in an upstream position with respect to the register position RP along a rotating direction of the circumferential surface of the dust remover roller 212 being rotated.

Figure 3:
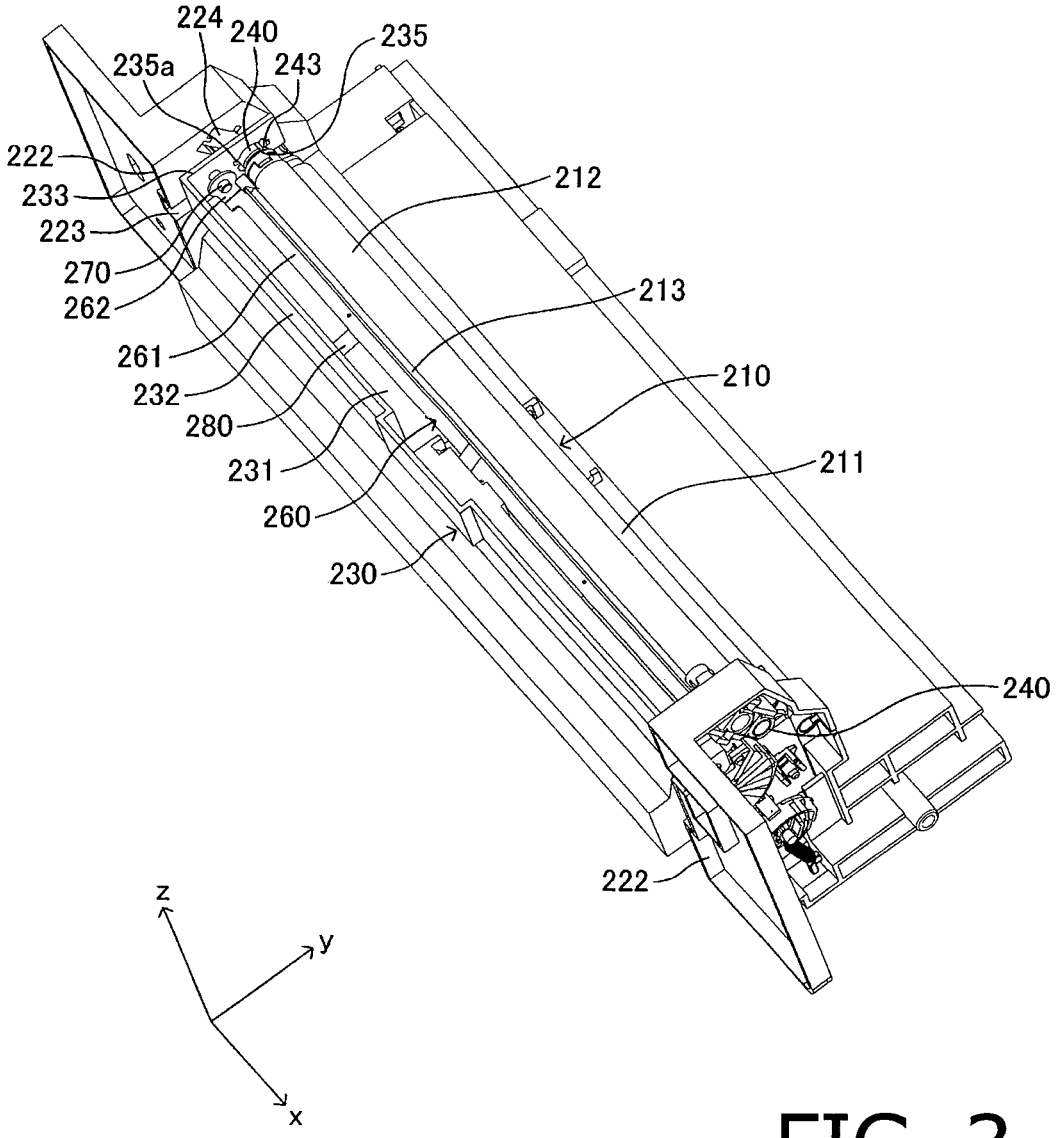
FIG. 3 is a perspective view of the sheet feeder unit with register rollers in the color laser printer according to the embodiment of the present invention.
Figure 4:
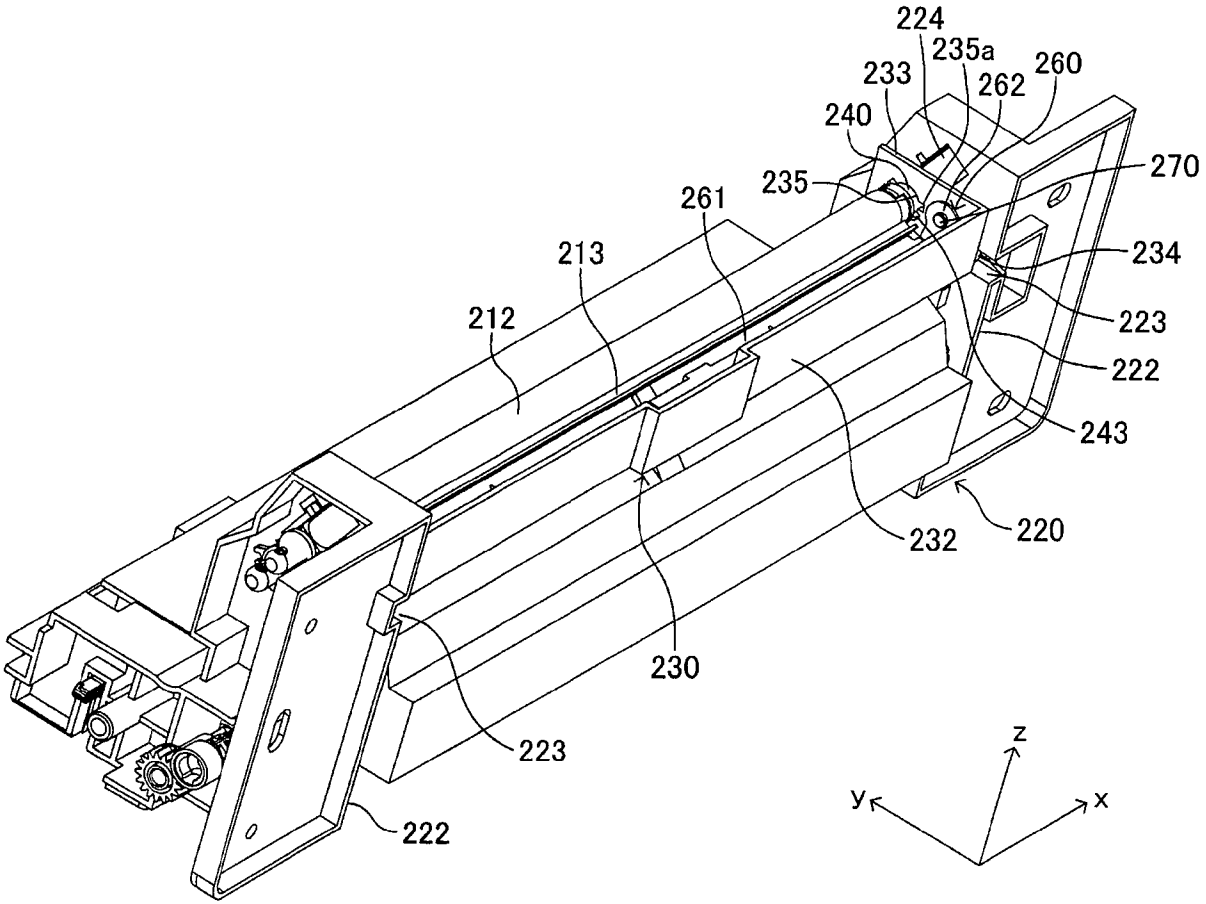
FIG. 4 is a perspective view of the sheet feeder unit with the register rollers in the color laser printer according to the embodiment of the present invention.

An area relevant to the register rollers 210 in the sheet feeder unit 2 is shown in FIGS. 2-4. The relevant area in the sheet feeder unit 2 will be described in detail below.

The sheet feeder 2 has a frame 220 made of a synthetic resin which rotatably supports the above-mentioned rollers. In particular, the frame 220 includes a bottom frame 221 and a pair of lateral frames 222. The bottom frame 221 is arranged to lie along the widthwise direction in a lower section in the frame 220. The separator roller 204 is rotatably supported by the bottom frame 221. Further, the pickup roller 203 is rotatably and vertically movably supported by the bottom frame 221.

The lateral frames 222 include planes which are arranged orthogonally with respect to the direction of sheet-width and are arranged in parallel with each other at widthwise ends of the bottom frame 221. The driving register roller 211 is rotatably supported by the lateral frames 222. At the same time, the driving register roller 211 is rotatably supported by the lateral frames 222 with a rotation axis thereof, which extends in parallel with the direction of sheet-width, to be neither movably nor swingably in the direction of height or depth. In other words, the rotation axis of the driving register roller 211 is fixed with respect to the lateral frames 222. Meanwhile, the dust remover roller 212 is rotatably supported by the lateral frames 222 to have a rotation axis thereof to be slidable along an in-axes direction (as indicated in a dash-and-dot line in FIG. 1) between the driving register roller 211 and the dust remover roller 212.

The structure to support the dust remover roller 212 in the frame 220 will be described below in detail. Each of the lateral frames 222 is formed to have a boxed guide groove 223 and a bearing guide groove 224. The boxed guide grooves 223 are inwardly 90-degrees transverse U-shaped grooves (in a side view), which are therefore open frontward and inward along the direction of sheet-width, and are formed to have lengthwise dimensions thereof to coincide with the direction of depth of the sheet feeder unit 2. Further, the boxed guide grooves 223 are formed to be constant in height throughout widthwise ranges along the widthwise direction and in width throughout vertical ranges along the vertical direction. The bearing guide grooves 224 are through-holes formed approximately in a shape of rectangle, of which longitudinal dimension coincides with the in-axes direction between the driving register roller 211 and the dust remover roller 212. The bearing guide grooves 224 are formed to penetrate thickness of the lateral frames 222 along the direction of sheet-width.

In an upper section of the frame 220, a dust container box 230 is attached to the frame 220. The dust container box 230 is provided to catch the dust scraped off from the circumferential surface of the dust remover roller 212 at a lower position with respect to the contact position where the dust remover roller 212 and the scraper pad 213 contact each other. The dust container box 230 has a shape of a partially-open box, which is open upward and rearward, to surround a part of the dust remover roller 212. Thus, a lower-rear part of the circumferential surface of the dust remover roller 212, from which the dust has been scraped off by the scraper pad 213, is exposed from the dust container box 230. Therefore, the dust container box 230 can catch and store the dust scraped off by the scraper pad 213 at the lower position, and the dust remover roller 212 is allowed to face the driving register roller 212 at the exposed lower-rear part across the sheet path PP at the register position RP (see FIG. 1). The dust container box 230 includes a bottom plate 231, a front plate 232, and a pair of lateral plates 233.

The bottom plate 231 is disposed to extend in parallel with the direction of sheet-width and orthogonally with respect to the vertical direction at a lower position with respect to the scraper pad 213 and the dust remover roller 212 to bridge space between lower ends of the lateral plates 233. The bottom plate 231 is formed and arranged to have a rear edge thereof to come in a position closer to the front with respect to the register position RP in order to allow the lower-rear circumferential surface of the dust remover roller 212 to be exposed and face the driving register roller 211 at the register position RP (see FIG. 1).

The front plate 232 is a plate connected to a front edge of the bottom plate 231 in an upright orientation with respect to the bottom plate 231 and fences a front side (i.e., a side closer to the scraper pad 213 with respect to the dust remover roller 212) of a section surrounded by the bottom plate 231 and the pair of lateral plates 233.

The lateral plates 233 are formed and arranged to have shapes of a rectangle, of which longitudinal edges extend to coincide with the direction of depth in a side view. The lateral plates 233 are arranged to have planes thereof to extend orthogonally with respect to the rotation axis of the dust remover roller 212 and to the direction of sheet-width.

Each of the lateral plates 233 is formed to have a cylindrical-shaped protrusive pin 234, which protrudes outward along the direction of sheet-width from an outer surface of the lateral plate 233. The pins 234 on the lateral plates 233 allow the dust container box 230 to be slidable along the direction of depth and rotatably supported in the box guide grooves 223, and restrict the dust container box 230 from being vertically moved or displaced. The pins 234 are formed integrally with the lateral frames 233 respectively and are arranged in positions to have axes thereof to coincide with each other along the direction of sheet-width.

In each lateral plates 233, further, a bearing attachable opening 235 is formed. The bearing attachable opening 235 is a circular opening, which penetrates thickness of the lateral plates 233 along the direction of sheet-width. The bearing attachable openings 235 are formed in positions closer to the rear with respect to lengthwise centers of the lateral plates 233 and in positions to have axes thereof to coincide with each other along the direction of sheet-width. Further, each of the bearing attachable opening 235 is formed to have a pair of engageable cutouts **235*a*, which protrude outward along radial directions of the bearing attachable opening 235. The engageable cutouts 235*a* are formed approximately in a shape of a rectangle in a side view in symmetric positions with respect to the axis of the bearing attachable opening 235 along the circumferential edge of the bearing attachable opening 235**.

To each lateral plate 233, a roller bearing 240 to support the dust remover roller 212 rotatably is attached. The roller bearing 240 is inserted in the bearing attachable opening 235 to penetrate the lateral plates 233 to be substantially immovable with respect to the lateral plates 233 in the direction of rotation axis of the dust remover roller (i.e. the direction of sheet-width) and to support the dust remover roller 212 rotatably within the dust container box 230. The roller bearing 240 being attached to the dust container box 230 and rotatably supporting the dust remover roller 212 is slidably set in the bearing guide groove 224 formed in the lateral frame 222 to be slidable along the in-axes direction between the driving register roller 211 and the dust remover roller 212.

Figure 5:
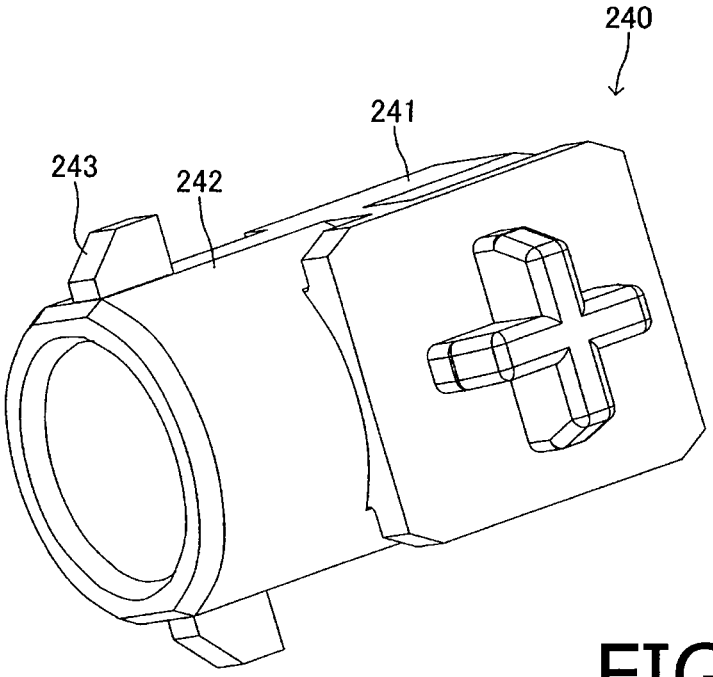
FIG. 5 is a perspective view of a roller bearing for a dust remover roller in the sheet feeder unit of the color laser printer according to the embodiment of the present invention.
Figure 6:
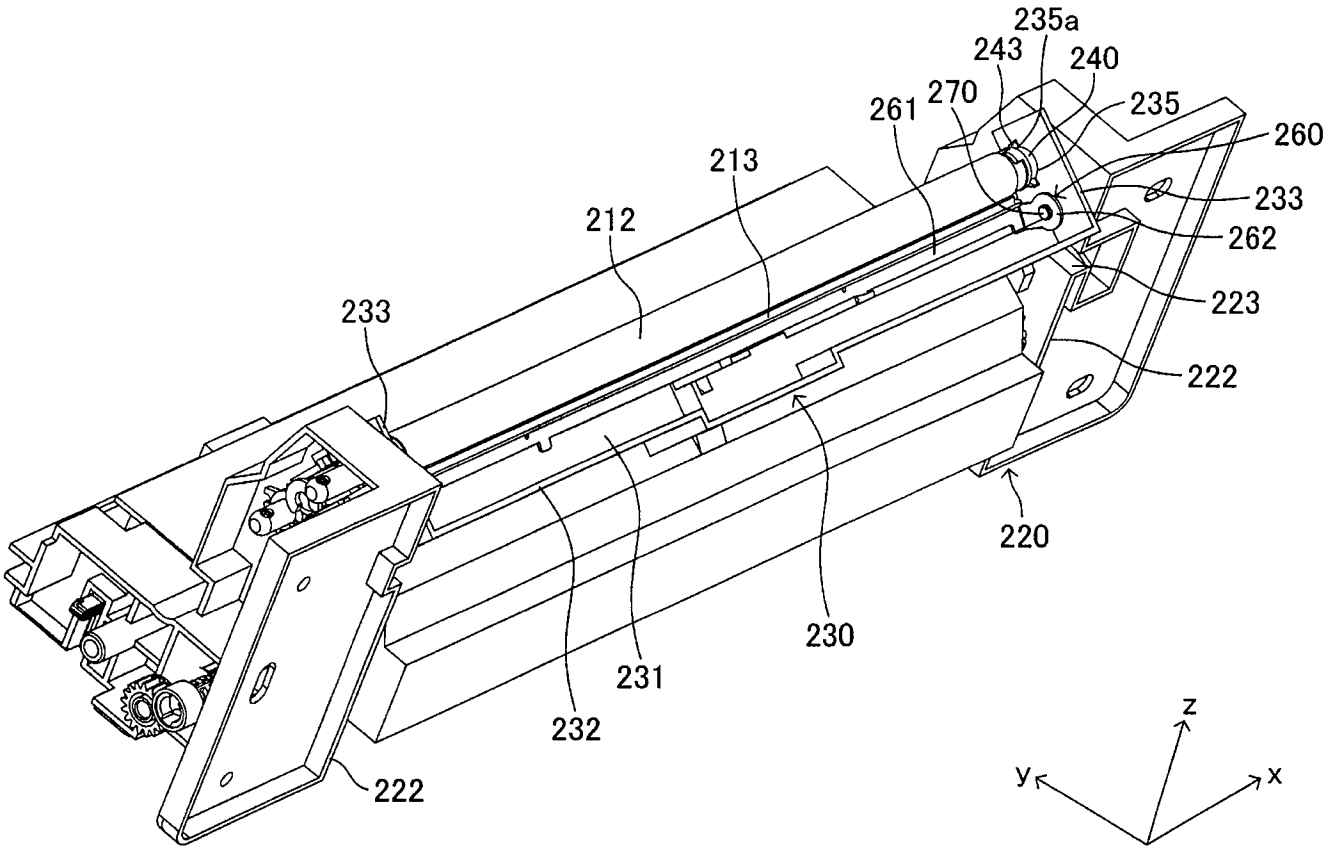
FIG. 6 is a perspective view of the roller bearing being installed in a dust container box in the feeder unit of the color laser printer according to the embodiment of the present invention.
Figure 7:
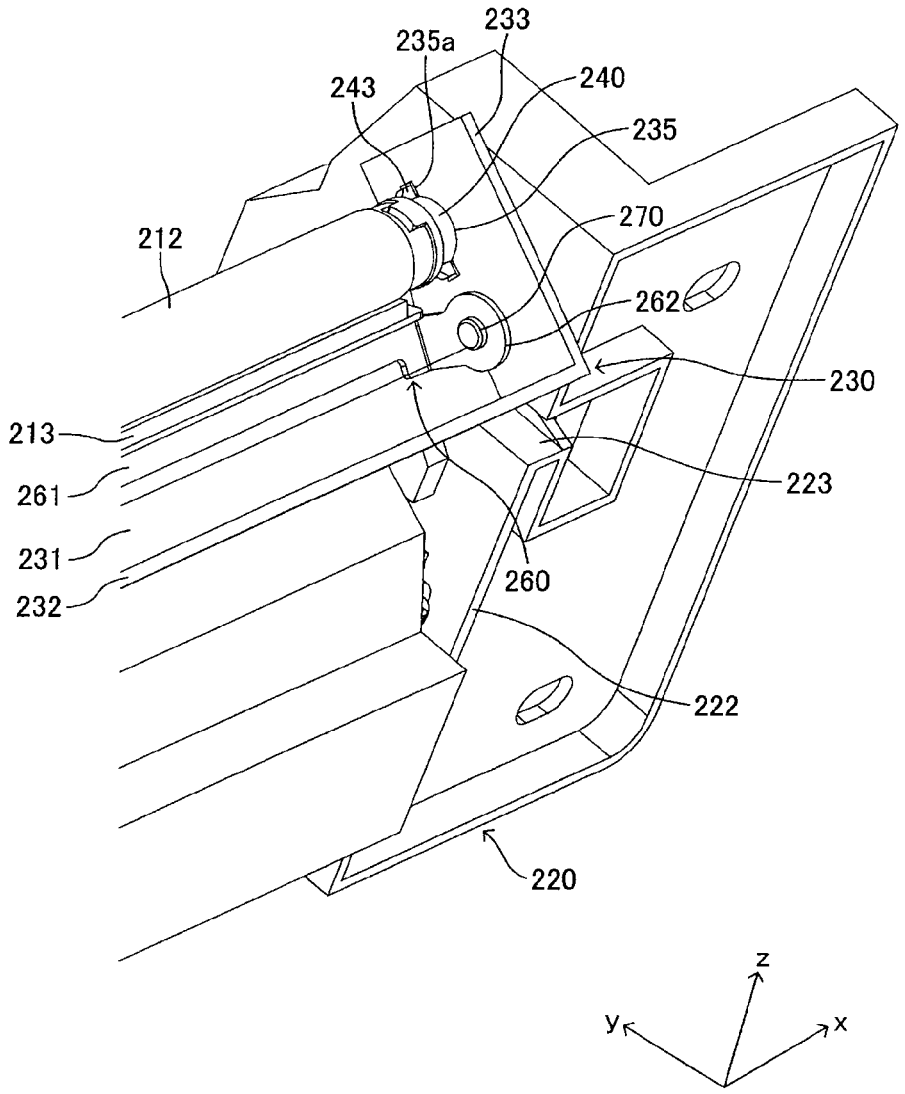
FIG. 7 is an enlarged partial view of the bearing being installed in the dust container box in the color laser printer shown in FIG. 6 according to the embodiment of the present invention.
Figure 8:
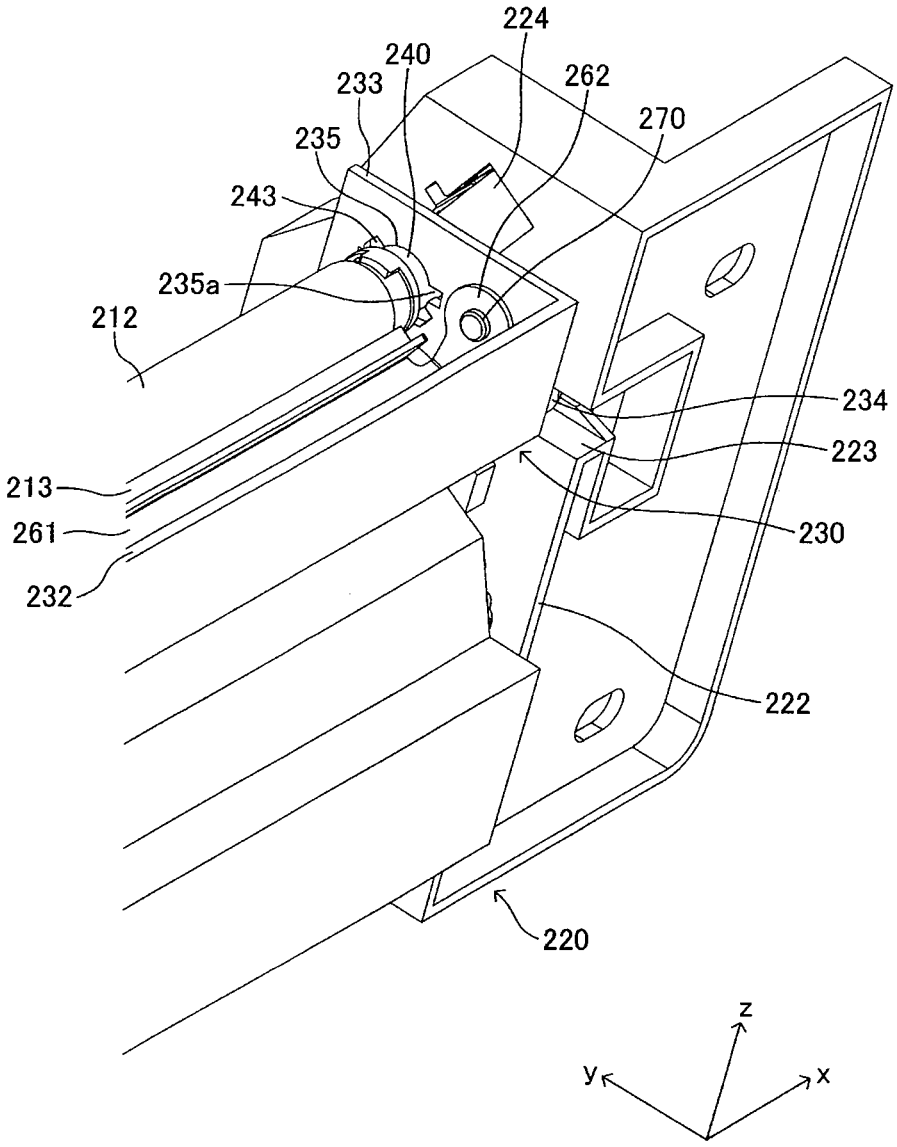
FIG. 8 is an enlarged partial view of the roller bearing shown in FIG. 4 in the feeder unit of the color laser printer according to the embodiment of the present invention.

Configuration of the roller bearing 240 will be described in detail with reference to FIGS. 3-5. The roller bearing 240 includes a base section 241, a protrusive section 242, and a pair of engageable pieces 243.

The base section 241 is formed to have a shape of a cube, which can be supported in the bearing guide groove 224 fit-slidably along the in-axes direction without being allowed to rotate in the bearing guide groove 224.

The protrusive section 242 is formed to have a shape of a cylinder having a predetermined dimension of outer diameter, which allows the protrusive section 242 is closely fitted in an inner diameter of the bearing attachable opening 235. For example, when a dimensional tolerance of the inner diameter of the bearing attachable opening 235 is H7, a dimensional tolerance of the outer diameter of the protrusive section 242 may be h7, which is equivalent to the inner diameter of the bearing attachable opening 235. The protrusive section 241 protrudes from the base section 241 inwardly along the direction of sheet-width.

The engageable pieces 243 are formed at an inner end portion of the protrusive section to protrude outward along radial directions of the cylinder-shaped protrusive section 242. The engageable pieces 243 are in symmetric positions with respect to an axis of the protrusive section 242 along the circumference of the protrusive section 242. The engageable pieces 243 are formed in a shape and a size to be inserted in the engageable cutouts **235*a* when the protrusive section 242 of the roller bearing 240 is inserted in the bearing attachable opening 235. Therefore, the engageable pieces 243 are allowed to be placed inside the lateral frame 233 along the direction of sheet-width. Once the engageable pieces 243 is placed inside the lateral frame 233, the protrusive section 242 of the roller bearing 240 is rotated with respect to the lateral plates 233 to be placed in displaced positions from the engageable cutouts 235***a*, and the engageable pieces 243 become in contact with an inner surface of the lateral plates 233.

Meanwhile, in the dust container box 203, the scraper pad 213 and a pad support 260 are arranged. The pad support 260 includes a pad-fixing bar 261 and a pair of swing arms 262. The pad-fixing bar 261 is an elongated flat plate extending along the direction of sheet-width, and the scraper pad 213 is fixed to the pad-fixing bar 261.

The swing arms 262 are flat pieces formed to extend upwardly from lengthwise ends of the pad-fixing bar 261 and are arranged to face the lateral frames 233 respectively. More specifically, the swing arms 262 are formed integrally with the pad-fixing bar 261 to have ligulate shapes, which extend outward from the lengthwise ends of the pad-fixing bar 261 and are bended upwardly at the lengthwise ends of the pad-fixing bar 261. The swing arms 262 are swingably supported by the lateral plates 233 via support pins 270, which extend along the direction of sheet-width. Thus, the pad support 260 supports the scraper pad 213 to be swingable about the support pins 270 at a position apart from the support pins 270.

As shown in FIG. 3, in a position between the front plate 232 of the duct container box 230 and the pad-fixing bar 261 of the pad support 260, a spring 280 is provided. The spring 280 urges the pad-fixing bar 261 toward the dust remover roller 212. By the urging force of the spring 280, the scraper pad 213 is placed to be in contact with the circumference of the dust remover roller 212.

Effects

A method to attach the dust remover roller 240 to the dust container box 230 and exemplary effects of the method according to the embodiment will be described below with reference to FIGS. 4-8.

Firstly, the roller bearings 240 are inserted from the outer sides of the lateral frames 230 in the bearing guide grooves 224 with the engageable pieces 243 facing inward along the direction of sheet-width. In this regard, the dust container box 230 is held in an inclined posture with the side closer to the bearing attachable opening 235 (i.e., the side with the open-ended edges of the lateral plates 233) being higher than the side further from the bearing attachable opening 235 (i.e., the side with the front plate 232) along the direction of depth (see FIGS. 6 and 7). With the roller bearings 240 being inserted in the bearing guide grooves 224, the axial ends of the dust remover roller 212 are inserted in the roller bearings 240 to be rotatable with respect to the roller bearings 240. In this regard, the protrusive sections 242 of the roller bearings 240 penetrate the lateral plates 233 inwardly with the engageable pieces 243 being inserted through the engageable cutouts 235*a* and placed the inner side of the lateral plates 233. Further, the base sections 241 of the roller bearings 240 are placed slidably in the bearing guide grooves 224.

Secondly, the roller bearings 240 are lowered along the bearing guide grooves 224. Accordingly, the dust container box 230 rotates about the pins 234, which are inserted in the boxed guide grooves 223. In this regard, the pins 234 slide frontward along the boxed guide grooves 223 along with the rotation of the dust container box 230. Further, the lateral plates 233 rotate with respect to the protrusive sections 242 of the roller bearing 240. In other words, the protrusive sections 242 rotate relatively to the lateral plates 233, and the engageable pieces 243 are placed in positions displaced from the engageable cutouts 235*a* (see FIGS. 4 and 8). Thus, the roller bearings 240 are restricted from being movable in the direction of sheet-width with respect to the lateral frames 233. Although small amounts of rattles may occur between the roller bearings 240 and the lateral frames 233, the roller bearings 240 are substantially fixed to the lateral frames 233 and restricted from being moved in the axial direction of the dust remover roller 212.

When the roller bearings 240 are thus attached to the dust container box 230, and when the dust remover roller 212 is rotatably supported by the dust container box 230 inside the dust container box 203 via the roller bearings 240, the frame 220 supports the pins 234 of the dust container box 230 to be slidable along a direction from the rotation axis of the dust remover roller 212 toward the support pin 270 being the swing axis of the pad support 260 and to be rotatable in the box guide groove 223. Further, the frame 220 supports the roller bearing 240 attached to the dust container box 230 to be slidable along the in-axes direction within the bearing guide grooves 224. Thus, the dust remover roller 212 is supported by the frame 220 to be rotatable and is allowed to smoothly slide along the in-axes direction according to thickness of the sheet P.

In this regard, as has been mentioned above, the pad support 260 is swingably supported by the dust container box 230, and the roller bearings 240 rotatably supporting the dust remover roller 212 are fixed to the dust container box 230. In other words, the pad support 260 supporting the scraper pad 213 and the dust remover roller 212 held in the roller bearings 240 are coupled to each other via the dust container box 230. Thus, the scraper pad 213 is placed in condition to be in steadily contact with the circumferential surface of the dust remover roller 212 along the direction of sheet-width. Accordingly, the dust can be effectively removed from the circumferential surface of the dust remover roller 212.

Further, the contact area, in which the circumferential surface of the dust remover roller 212 and the scraper pad 213 contact each other is enclosed by the dust container box 230 from three directions (at the lateral sides, the front side, and the lower side). Therefore, the dust scraped off from the dust remover roller 212 by the scraper pad 213 can be caught in the dust container box 230, and it may be prevented that the removed dust leaks outside the dust container box 230.

With the circumferential surface of the dust remover roller 212 and the scraper pad 213 being steadily in contact with each other, the roller bearing 240 is allowed to slide along the in-axes direction. Therefore, the condition, in which scraper pad 213 steadily contacts the circumferential surface of the dust remover roller 212, and the condition, in which the contact area for the circumferential surface of the dust remover roller 212 and the scraper pad 213 is enclosed by the dust container box 230, are maintained whilst the dust remover roller 212 is movable in the in-axes direction with respect to the driving register roller 211. Thus, the sheets P are carried properly by the register rollers 210 in the sheet path PP whilst the dust is effectively removed from the sheets P.

Although an example of carrying out the invention has been described, those skilled in the art will appreciate that there are numerous variations and permutations of the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the image forming apparatus may not necessarily be the multi-colored laser printer but may be a monochrome printer or an inkjet printer. Further, the image forming apparatus may be a copier or a multifunction peripheral device having functions of, for example, a copier, a scanner, and a printer.

What is claimed is:

1. An image forming apparatus, which is configured to convey a sheet of recording medium and form an image on the sheet in an image forming unit, comprising:

a pair of register rollers including a driving roller, which is configured to be rotated to convey the sheet toward the image forming unit and which has a rubber-made circumferential layer, and a dust remover roller, which is configured to have a smooth circumferential surface to remove dust from the sheet being conveyed and which is arranged in a position opposite from the driving roller, the register rollers being configured to correct an orientation of the sheet being carried when an edge of the sheet contacts the register rollers when the driving roller and the dust remover roller are closest to each other;

a dust scraper, which is arranged to face and to be in contact with the circumferential surface of the dust remover roller to scrape off the dust from the circumferential surface of the dust remover roller;

a dust container box including at least a lateral plate, which is arranged orthogonally to a rotation axis of the dust remover roller, and a cylindrical-shaped pin, which is configured to protrude outwardly from the lateral plate, the dust container box being configured to have a shape of a box lo contain the dust scraped off from the circumferential surface of the dust remover roller by the dust scraper;

a roller bearing, which is configured to penetrate the lateral plate and to be attached to the lateral plate to be immovable with respect to the lateral plate in a direction of the rotation axis of the dust remover roller and configured to rotatably support the dust remover roller within the dust container box;

a scraper support, which is arranged in the dust container box and is configured to be swingably supported by the dust container box to swing about a swing axis parallel with the rotation axis of the dust remover roller, and to support the dust scraper at a position apart from the swing axis; and a frame configured to support the dust container box swingably and having a box-guiding groove configured to guide the dust container box and a bearing-guide groove configured to guide the roller bearing, the box-guiding groove being formed along a first direction orthogonal to the rotation axis of the dust remover roller and being configured to support the cylindrical-shaped pin slidably along the first direction orthogonal to the rotation axis of the dust remover roller and rotatably therein, the frame being configured to rotatably support the driving roller, whilst a rotation axis of the driving roller is fixed with respect to the frame, and to support the roller bearing to be slidable along a second direction in which the dust remover roller comes closer to the driving roller in the bearing-guide groove, wherein the cylindrical-shaped pin is configured to slide in the box-guiding groove in the first direction orthogonal to the rotation axis of the dust remover roller, and the dust container box is configured to rotate about the cylindrical-shaped pin such that, when the roller bearing slides in the bearing-guiding groove in the second direction in which the dust remover roller comes closer to the driving roller, the cylindrical-shaped pin slides in the box-guiding groove in the first direction orthogonal to the rotation axis of the dust remover roller and the dust container box rotates about the cylindrical-shaped pin.

2. The image forming apparatus according to claim 1, further comprising an urging member, which is configured to urge the scraper support toward the dust remover roller to have the dust scraper in contact with the circumferential surface of the dust remover roller and is arranged in a position between the dust container box and the scraper support.

3. The image forming apparatus according to claim 1, wherein the driving roller, the dust remover roller, and the dust scraper are configured to have forms, which correspond to a width of a maximum-allowable sized sheet of recording medium for the image forming apparatus.

4. An image forming apparatus, which is configured to convey a sheet of recording medium and form an image on the sheet in an image forming unit, comprising:

a pair of register rollers including a driving roller, which is configured to be rotated to convey the sheet toward the image forming unit and which has a rubber-made circumferential layer, and a dust remover roller, which is configured to have a smooth circumferential surface to remove dust from the sheet being conveyed and which is arranged in a position opposite from the driving roller, the register rollers being configured to correct an orientation of the sheet being carried when an edge of the sheet contacts the register rollers when the driving roller and the dust remover are closest to each other;

a dust scraper, which is arranged to face and to be in contact with the circumferential surface of the dust remover roller to scrape off the dust from the circumferential surface of the dust remover roller;

a dust container box including at least a lateral plate, which is arranged orthogonally to a rotation axis of the dust remover roller, and a protrusion, which is configured to protrude outwardly along a direction of the rotation axis of the dust remover roller from the lateral plate, the dust container box being configured to have a shape of a box to contain the dust scraped off from the circumferential surface of the dust remover roller by the dust scraper;

a roller bearing, which is configured to penetrate the lateral plate and to be attached to the lateral plate to be immovable with respect to the lateral plate in the direction of the rotation axis of the dust remover roller and configured to rotatably support the dust remover roller within the dust container box;

a scraper support, which is arranged in the dust container box and is configured to be swingably supported by the dust container box to swing about a swing axis parallel with the rotation axis of the dust remover roller, and to support the dust scraper at a position apart from the swing axis; and a frame configured to swingably support the dust container box via a protrusion support, which supports the protrusion of the dust container box slidably along a first direction orthogonal to the rotation axis of the dust remover roller and rotatably therein, the frame being configured to rotatably support the driving roller, whilst a rotation axis of the driving roller is fixed with respect to the frame, and to support the roller bearing to be slidable in a bearing-guiding groove configured to guide the roller bearing along a second direction in which the dust remover roller comes closer to the driving roller, wherein the protrusion is configured to slide in the protrusion support in the first direction orthogonal to the rotation axis of the dust remover roller, and the dust container box is configured to rotate about the protrusion such that, when the roller bearing slides in the bearing-guiding groove in the second direction in which the dust remover roller comes closer to the driving roller, the protrusion slides in the protrusion support in the first direction orthogonal to the rotation axis of the dust remover roller and the dust container box rotates about the protrusion.

5. The image forming apparatus according to claim 4, wherein the protrusion in the dust container box is a cylindrical-shaped pin; and wherein the protrusion support is a groove, which is formed along the first direction orthogonal to the rotation axis of the dust remover roller and is configured to support the cylindrical-shaped pin slidably and rotatably therein.

6. The image forming apparatus according to claim 4, further comprising an urging member, which is configured to urge the scraper support toward the dust remover roller to have the dust scraper in contact with the circumferential surface of the dust remover roller and is arranged in a position between the dust container box and the scraper support.

7. The image forming apparatus according to claim 4, wherein the driving roller, the dust remover roller, and the dust scraper are configured to have forms, which correspond to a width of a maximum-allowable sized sheet of recording medium for the image forming apparatus.

* * * * *